US008210571B2

(12) United States Patent
Royle

(10) Patent No.: US 8,210,571 B2
(45) Date of Patent: Jul. 3, 2012

(54) BOOK COVER

(75) Inventor: Clifford Royle, Patterson Lakes (AU)

(73) Assignee: Roylebind Pty Ltd., Bayswater, Victoria (AU)

( * ) Notice: Subject to any disclaimer, the term of this patent is extended or adjusted under 35 U.S.C. 154(b) by 908 days.

(21) Appl. No.: 11/885,604

(22) PCT Filed: Mar. 3, 2006

(86) PCT No.: PCT/AU2006/000283

§ 371 (c)(1),
(2), (4) Date: Nov. 28, 2007

(87) PCT Pub. No.: WO2006/092027

PCT Pub. Date: Sep. 8, 2006

(65) Prior Publication Data

US 2008/0164687 A1 Jul. 10, 2008

(30) Foreign Application Priority Data

Mar. 3, 2005 (AU) ..... 2005901012
Dec. 7, 2005 (AU) ..... 2005906882

(51) Int. Cl.
*B42D 3/04* (2006.01)

(52) U.S. Cl. ..... 281/34; 281/4; 281/19.1

(58) Field of Classification Search ..... 412/4, 3; 281/4, 19.1, 29, 34, 35; 220/62; 150/131, 150/132

See application file for complete search history.

(56) References Cited

U.S. PATENT DOCUMENTS

| | | | | |
|---|---|---|---|---|
| 4,519,630 | A * | 5/1985 | Holmes | 281/31 |
| 4,615,541 | A * | 10/1986 | Kwauka | 281/29 |
| 4,850,611 | A * | 7/1989 | Skelton | 281/5 |
| 5,005,870 | A * | 4/1991 | Desmouliere | 281/21.1 |
| 5,871,323 | A * | 2/1999 | Clark | 412/4 |
| 6,451,397 | B1 * | 9/2002 | Hagen | 428/40.1 |
| 2003/0234531 | A1 * | 12/2003 | Silverman | 281/29 |

FOREIGN PATENT DOCUMENTS

WO WO 96/20837 * 7/1996

* cited by examiner

*Primary Examiner* — Edward Tolan
*Assistant Examiner* — Matthew G Katcoff
(74) *Attorney, Agent, or Firm* — Hamilton, Brook, Smith & Reynolds, P.C.

(57) ABSTRACT

A book cover (10) having a spine (26) and end covers (32) on either side of the spine (26) wherein the spine and end covers (32) are all formed from a single, folded blank (12) and the end covers (32) comprise at least two adhered layers of the folded blank.

7 Claims, 7 Drawing Sheets

BOOK COVER

RELATED APPLICATIONS

This application is the U.S. National Stage of International Application No. PCT/AU2006/000283, filed Mar. 3, 2006, published in English, and claims priority under 35 U.S.C. §119 or 365 to Australian Application No. 2005901012, filed Mar. 3, 2005, and Australian Application No. 2005906882 filed Dec. 7, 2005.

The present invention relates to a book cover, a method of making a book cover and an apparatus for making a book cover. The invention also relates to a book formed by attaching pages to the book cover.

BACKGROUND

The two most popular constructions of books are hard back books and soft back books. Hard back books comprise hard front and back covers that protect the pages of a book from wear and generally extend the life of the book. The hard covers are usually made of hard cardboard panels laminated with a thin laminate cover on the exterior and laminated with a paper sheet on the interior. Hard back books are more costly than soft back books as hard back book covers require more material and the process of making the covers is more involved.

Soft back covers are the more economical choice of book cover comprising only one layer of thick paper, which is printed on one side but the drawback with these covers is they provide little protection to book pages. Eventually wear and tear leads to degradation of the book and possible tearing of pages.

There is a need for a book cover that can be manufactured economically but which will provide adequate protection and strength to a book.

SUMMARY OF INVENTION

In one aspect the present invention provides a book cover having a spine and end covers on either side of the spine wherein the spine and end covers are all formed from a single, folded blank and the end covers comprise at least two adhered layers of the folded blank.

Preferably the end covers comprise three or four layers of the folded blank, with the layers being adhered to one another by glue. The spine preferably comprises one or two layers of the folded blank. All the edges of the book cover are preferably rolled, that is folded.

A continuous image may be printed on both the internal and external sides of at least one end cover. Alternatively, a continuous image may be printed along the external and internal sides of both end covers.

The spine is preferably formed by crease lines embossed on the blank. Additionally, one or more covers may be provided with decorative embossing.

The blank is preferably a one sided coated board, and in particular strawboard, having a thickness in the range of 0.1 mm to 1 mm, which in the industry measurements of "ums" (or microns) calculates to 100 to 1000 ums. Preferably the thickness is 200 to 600 ums. In terms of weight the board is preferably in the range of 100 to 500 gsm (grams per square meter) and more preferably 200 to 370 gsm. The blank is preferably laminated on one side with a 15 ums polypropylene laminate using a water based and pH neutral adhesive. The side on which the blank is laminated is the side which bears the print lamination may be confined to only the printed area to enable adhesion between layers.

In another aspect the invention provides a book having a book cover as described above with pages adhered to the spine of the book cover.

In accordance with a further aspect the present invention provides a method of making a book cover comprising:

form cutting a blank from a sheet material, wherein the blank has a substantially rectangular central section, a first set of flaps on opposite sides of the central section and a second set of flaps on the remaining opposite sides of the central section;

folding the first set of flaps along first fold lines and adhering the first set of flaps onto the central section; and folding the second set of flaps along second fold lines and adhering the second pair of flaps onto the first pair of flaps thereby forming a book cover having a spine and an end cover on either side of the spine wherein the end covers are formed having multiple layers of sheet material.

The first set of flaps may comprise a pair of flaps or a set of flour flaps, wherein the first set of flaps is folded across the spine or along either side of the spine. The first set of flaps may each fold onto themselves at least once to form a four or more layered book cover.

The method preferably comprises printing an image on one side of the blank before folding the flaps, and then laminating at least a part of the printed side.

Before folding the flaps, the method preferably comprises embossing crease lines through the central section and on at least one of the pair of flaps to define the spine of the book cover. While embossing the crease lines the blank may also be decoratively embossed on one side before folding the flaps.

The flaps and central section are preferably adhered together by gluing. In one embodiment, the glue used is cold polyvinyl acetate (PVA) adhesive and is rolled on to the blank.

In a further aspect the present invention further provides a method of making a book comprising:

form cutting a blank from a sheet material wherein the blank has a substantially rectangular central section, a first set of flaps on opposite sides of the central section and a second set of flaps on the remaining opposite sides of the central section;

embossing spine crease lines through the central section;

folding the first set of flaps along first fold lines and adhering the first set of flaps onto the central section;

folding the second set of flaps along second fold lines and adhering the second set of flaps onto the first set of flaps thereby forming a book cover having a spine and an end cover on either side of the spine, wherein the end covers are formed having multiple layers of sheet material; and attaching pages of a book between the crease lines to form a book.

The pages are preferably attached to the spine between the crease lines by gluing. The glue used is preferably an ethol vinyl acetate based hot melt adhesive and/or a synthetic based hot melt adhesive.

Preferably, the method includes embossing four parallel crease lines whereby two inner creases are embossed to crease in one direction and the two outer creases are embossed to crease in the opposite direction. The pages of the book are preferably glued to the blank in between the two inner crease lines.

In yet another aspect of the invention there is provided an apparatus for gluing and folding a blank to form a book cover including:

an in-feed conveyor which conveys a blank of sheet material towards an adhesive station, the adhesive station comprising two sets of adhesive rollers spaced symmetrically and laterally from a centre line of the apparatus, wherein the centre line lies in the direction of travel and the adhesive rollers operate to apply adhesive from an adhesive supply onto a selected area of the blank;

a travel conveyor to transfer a blank from the adhesive station to a press; and folders located laterally of the centre line between the adhesive station and press to lift and fold opposite sides of the blank onto a central section of the blank.

BRIEF DESCRIPTION OF THE DRAWINGS

An embodiment, incorporating all aspects of the invention, will now be described by way of example only with reference to the accompanying drawings in which.

DETAILED DESCRIPTION OF PREFERRED EMBODIMENT

Figure 1A:
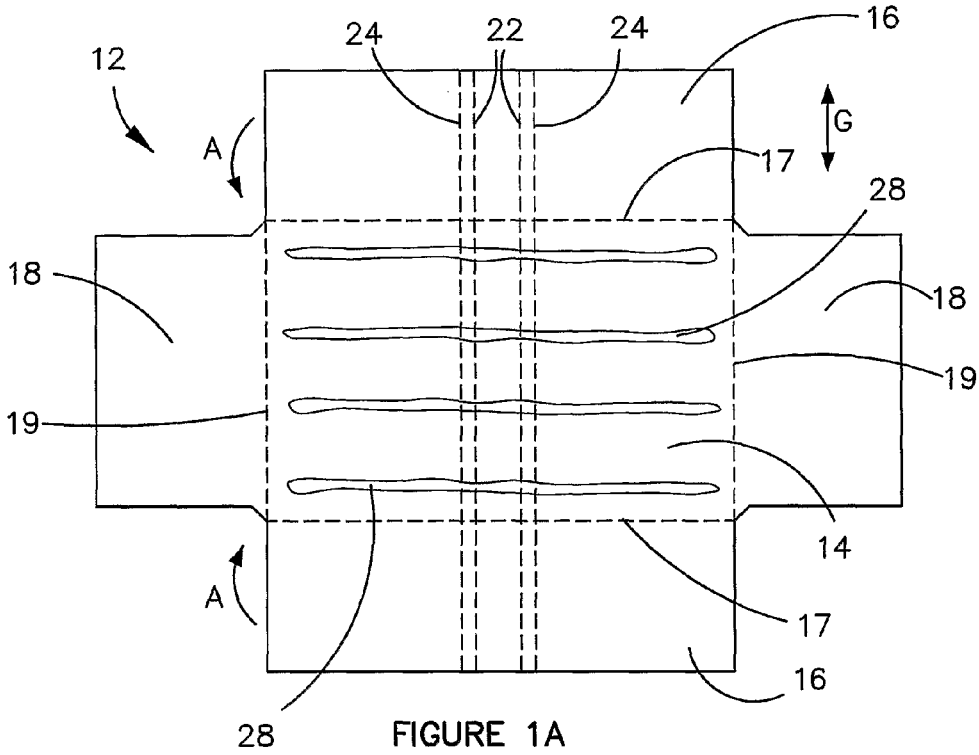
FIG. 1A illustrates a blank for a book cover in accordance with a first embodiment of the present invention.
Figure 1B:
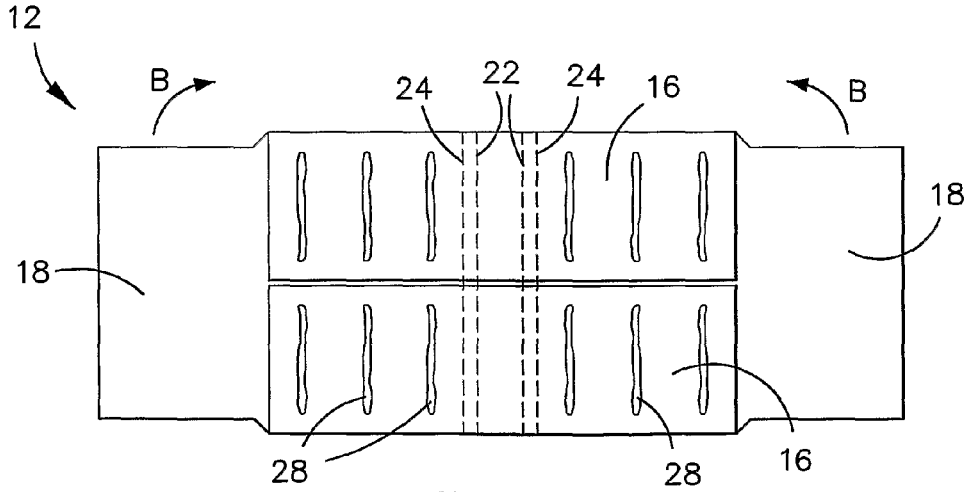
FIG. 1B illustrates the blank of FIG. 1A folded after a first step.
Figure 1C:
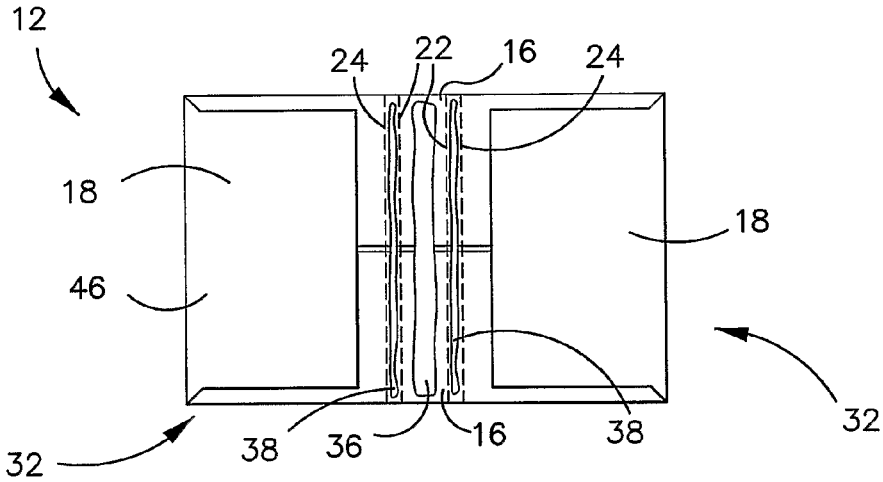
FIG. 1C illustrates the blank of FIG. 1B folded after a second step.
Figure 2:
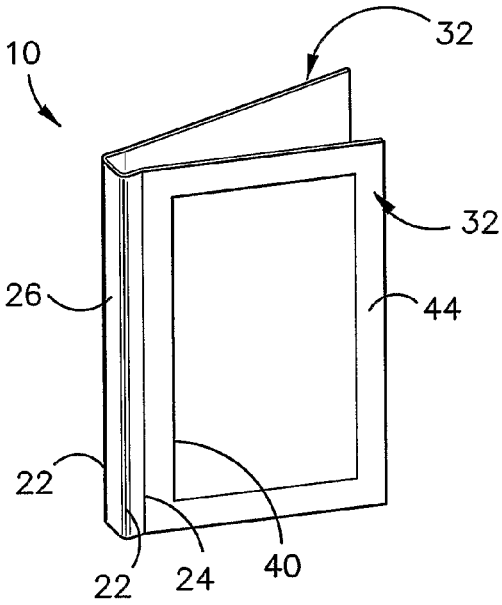
FIG. 2 illustrates a book cover in accordance with the first embodiment of the present invention.
Figure 3:
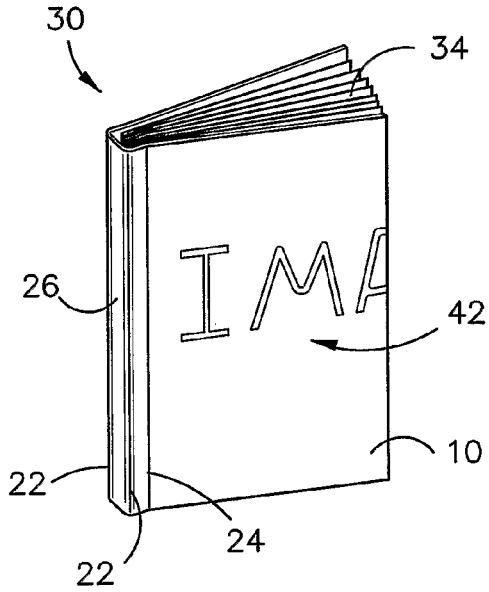
FIG. 3 illustrates a book having a book cover of an embodiment of the present invention.

FIGS. 1A to 1C illustrate a book cover 10 of a first embodiment of the present invention at sequential steps of manufacture. FIG. 2 illustrates the resulting book cover 10 while FIG. 3 illustrates a book 30 in which the pages are bound by the book cover 10 of FIG. 2.

Figure 4A:
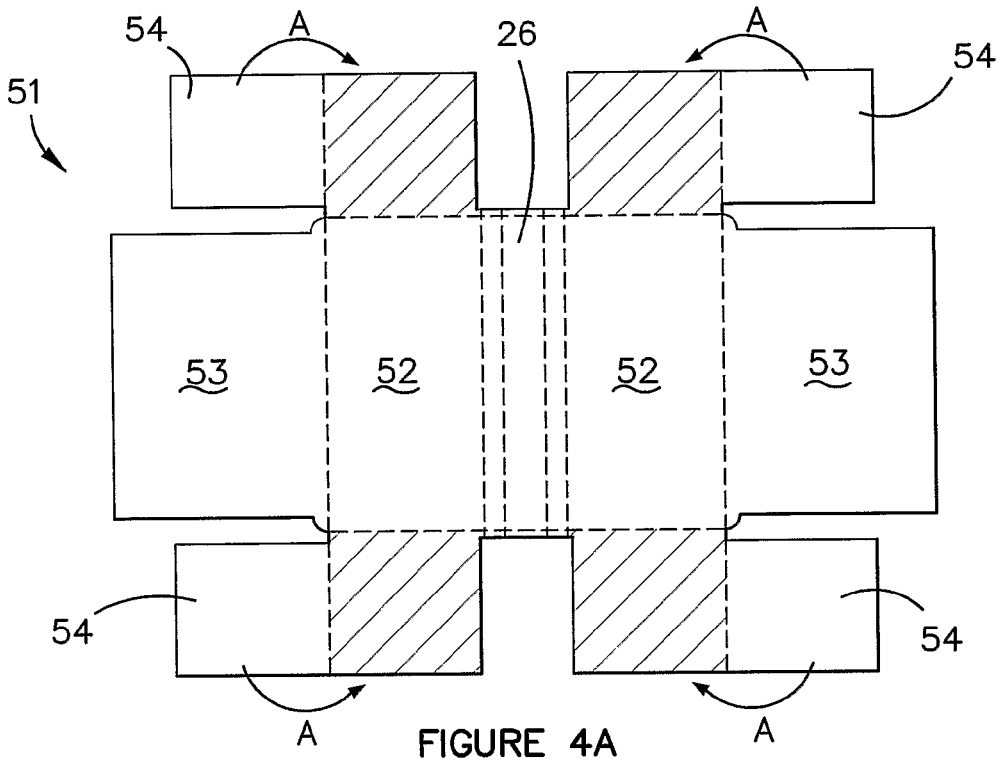
FIG. 4A illustrates a blank for a book cover in accordance with a second embodiment of the present invention.
Figure 4B:
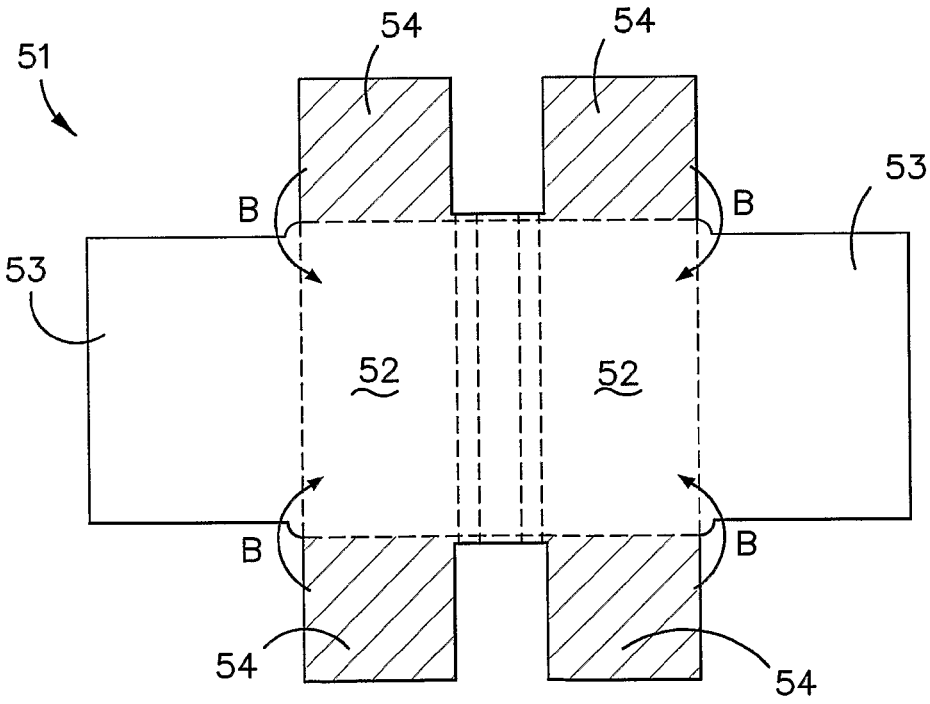
FIG. 4B illustrates the blank of FIG. 4A folded after a first step.
Figure 4C:
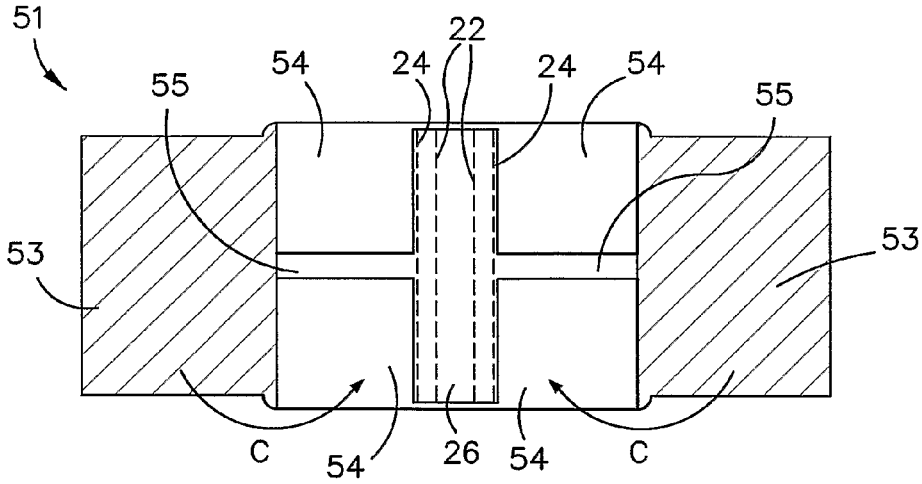
FIG. 4C illustrates the blank of FIG. 4B folded after a second step.
Figure 5:
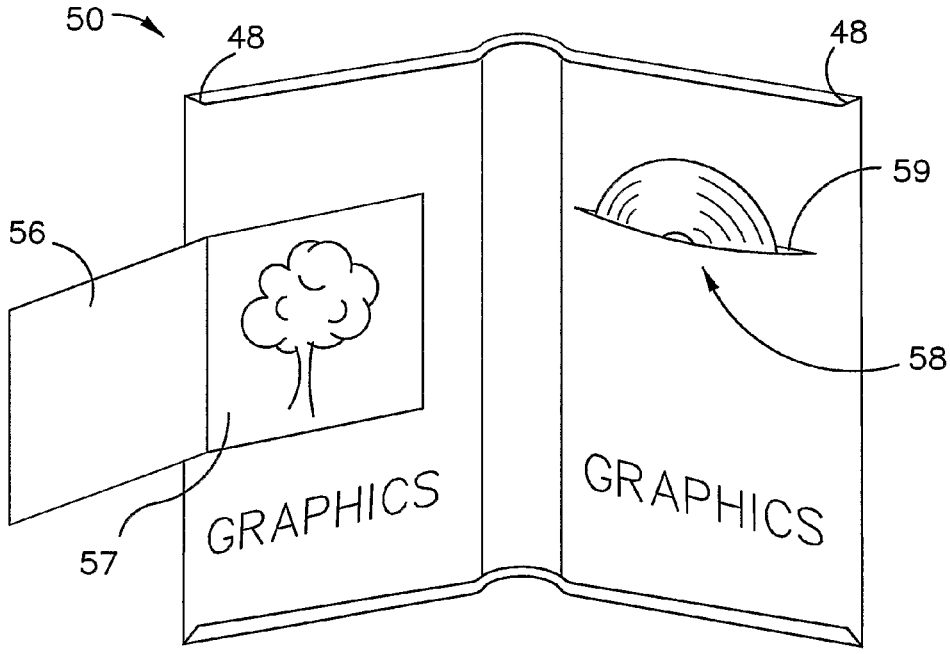
FIG. 5 illustrates a book cover in accordance with a second embodiment of the present invention.

FIGS. 4A to 4C illustrate a book cover 50 of a second embodiment of the present invention at sequential steps of manufacture. FIG. 5 illustrates the resulting book cover 50.

The book cover 10, 50 does not contain the thick cardboard of a hardback cover and therefore is more flexible than a hard back cover, but is also more rigid than a soft back cover. Additionally, the present book cover is stronger than both a hard back and soft back cover owing to its construction. Book cover 10, 50 provides good protection to the pages of a book and its physical characteristics make it ideal for use with all books in that it is lightweight yet provides sufficient strength and rigidity to withstand continual handling.

Book cover 10, 50 is created by folding a form cut blank 12 of a sheet material over onto itself to create a layered book cover. The sheet material is generally a paper-based material in the form of a cardboard and more typically is a one sided coated board where the printed areas on the one side of the board are coated with a laminate. However, it is understood that other material based sheets could be printed, cut and folded to create the present book cover. Examples of other materials include leather, vinyl plastics and any other suitable pulp-based materials.

The thickness of the blank is in the range of 100 ums to 1000 ums (i.e. 0.1 mm to 1 nm) and typically around 200 to 600 microns depending on the desired overall thickness of the book cover and on the technique used in making it, that is the number of layers. The weight of paper, and sometimes also board, is specified in gsm, namely grams per square meter. In the preferred embodiment the specification of board for a blank is between 200 and 370 gsm although it is possible to use boards having a weight of between 100 to 500 gsm, or even a weight outside of this range. This thickness of blank is chosen for its ease of folding and its durability and rigidity when adhered together into two, three or four layers.

After printing an image (that is, cover graphics, story synopsis, etc) on the coated side of the sheet material, the printed side of the sheet is laminated. The laminate is a 15 ums polypropylene laminate applied using a water based and pH neutral adhesive. The sheet material is then form cut and creased to create a blank ready for folding into the book cover. The laminate may not extend across the entire board surface, depending on how the blank is to be folded. It is undesirable for areas to be laminated where those areas will be folded and come into contract with adhesive. Adhesive will not bond well to a surface that is laminated.

In relation to the first embodiment and as illustrated in FIG. 1A, blank 12 comprises a substantially rectangular central section 14 surrounded on all sides by flaps or wings. A first pair of flaps 16 are located on opposite sides of central section 14 while a second pair of flaps 18 are located on the remaining opposite sides of central section 14. Flaps 16, 18 form part of blank 12 and are joined to central section 14 by way of first fold lines 17 corresponding to the first pair of flaps 16, and second fold lines 19 corresponding to the second pair of flaps 18. The fold lines 17, 19 are formed by creasing or embossing after blank 12 is cut from a larger sheet.

Also embossed at this stage are crease lines 22, 24 that will form the spine 26 of the book cover 10. Spine 26 is defined by four parallel crease lines in which inner crease lines 22 are embossed to fold in a first direction whereas outer crease lines 24 are embossed to fold in the opposite direction. In forming book cover 10 crease lines 22, 24 enable a roughly square section spine 26 to be created.

As illustrated in FIG. 1A crease lines 22, 24 and spine 26 extend in the same direction as the grain of the blank 12 as illustrated by arrow G. It is preferred to align the spine parallel to the direction of the grain G as this reduces buckling and jamming of the book cover during the process of binding pages. Binding machines are constructed to operate with book covers having the grain of the cover aligned in a particular direction. Furthermore, with the spine aligned with the grain of the sheet material, the spine of the present book cover is encouraged to act as a hinge and allow easy opening and closing of the book.

From the flat blank 12 illustrated in FIG. 1A the first pair of flaps 16 are folded in the direction of arrow A along first fold lines 17 over central section 14 and are adhered onto central section 14 into the configuration illustrated in FIG. 1B. Flaps 16 are folded inward of the unlaminated side of the blank 12. Lines of glue 28 are applied across central section 14 so that the first pair of flaps 16 adheres to central section 14 when folded. The glue is preferably applied on central section 14 across the spine so as to increase the spine strength. The preferred glue used in this instance is cold polyvinyl acetate (PVA) adhesive.

From this configuration the same glue 28 is applied in strips on the upper side of first flaps 16 vertically, horizontally or however desired. As there may be problems with adhesion of glue to the upper side of the laminated first flaps 16, the upper sides of first flaps 16 may remain unlaminated. Accordingly, the step of laminating the printed side of the sheet material would include avoiding laminating first flaps 16 with the laminated film being applied only to central section 14 and the second pair of flaps 18.

The second pair of flaps 18 is then folded in the direction of arrow B along second fold lines 19 to lie over and adhere to the first pair of flaps 16.

The resulting configuration is illustrated in FIG. 1C which when folded along crease lines 22, 24 produces the book cover 10 illustrated in FIG. 2. The book cover 10 is thereby defined by adhered layers of hard paper sheet derived from the single blank. Accordingly, the front and rear end leaves, or covers, 32 of book 30 are formed from three layers of the same sheet material.

While the preferred embodiment illustrates folding two pair of flaps over a central section to form end leaves having three layers, it is understood that the book cover may be also made from a blank having only one pair of flaps folded to give end leaves with only two layers. This type of arrangement is useful where a soft back-type cover is desired but with greater strength and resistance to wear than common soft backs. The double layered end covers further allows features such as compact disk pockets and hinged flaps to be incorporated.

Alternatively, the blank may comprise more than two pairs of flaps as illustrated in FIGS. 4A to 5.

In the embodiment illustrated in FIG. 1C the second pair of flaps 18 that fold along fold lines 19 are parallel to crease lines 22, 24, and fall short of extending over spine crease lines 22, 24. Accordingly, spine 26 of book cover 10 is only formed from two layers of adhered sheet material so as not to impede on the flexibility of manufacturing and using the book cover. However, it is understood that the second pair of flaps 18 could overlay the spine creases to form a stronger three layered spine or alternatively none of the flaps need overlap so that the spine has only one layer.

A second embodiment of the book cover is illustrated in FIG. 4A to 4C. FIG. 4A illustrates a form cut blank that has been creased to form fold lines. In the second embodiment the first set of slaps that fold onto a central section 52 comprise a set of four flaps: two on opposite sides of the central section with one to each side of the spine 26. Additionally each of the four first flaps has provision to be folded onto itself such that when the blank is folded and glued the end leaves of the resulting book cover comprise four layers of sheet material thereby providing a stiffer book cover than that of the first embodiment.

The form cut blank 51 of FIG. 4A comprises the central section 52 onto which the surrounding flaps are folded. Central section 52 is provided with a pair of large flaps 53 located on opposite sides of central section 52. On the remaining opposite sides of central section 52 are a set of four elongate flaps 54 that are hinged to central section 52 at only a part of one side of the flaps such that elongate flaps 54 can be folded onto themselves to create a smaller two layered flap for folding onto the central section.

The folding process begins at 4A and follows arrows A to fold each of the four elongate flaps onto themselves which results in the folded blank of FIG. 4B. As shown in FIG. 4B the folded elongate flaps 54 are then folded once more in the direction of arrow B to overlie the central section 52. At this point the folded blank has the appearance illustrated in FIG. 4C. The final folding process follows arrows C whereby large flaps 53 are folded onto the folded elongate flaps 54 on central section 52. This results in a book cover 50 illustrated in FIG. 5 (but without the feature window and CD holder illustrated in FIG. 5).

As will be noted from FIGS. 4A to 4C none of the large flaps 53 or elongate flaps 54 fold onto spine 26 thereby leaving spine 26 with only one layer of sheet material which makes the book cover easier to fold and assemble with a book block and comfortable to generally use as a book.

The shaded areas in FIGS. 4A to 4C represent the area to which glue is applied in order to adhere the layers together. Glue may be applied in glue strips as illustrated in FIGS. 1A and 1B or the glue may be rolled onto the entire shaded section in a uniformly distributed manner.

In the second embodiment depicted in FIGS. 4A to 4C edges 48 between large flaps 53 and elongate flaps 54 are rounded so to provide a more finished appearance in its final product as illustrated in FIG. 5. Additionally, rounded edges 48 assist in re-enforcing the corner of the book cover where the edges 48 are located to prevent tearing.

Once the book cover has been formed it is then passed through a conventional perfect binding machine to be assembled with a book block to form a complete book.

To form a complete book 30, a text book block of sewn or glued pages 34 is attached to the spine 26 of book cover 10, 50. Before adhering the text book block to the book cover, the pages of the text book block are bound with a false cover which remains in the final form of the book as end paper to the pages. Commonly, in case binding hard back books this false cover is removed before attaching to the book cover. With binding the present book the step of removing the false cover is eliminated, thereby shortening the binding process, and instead the false cover provides end covers between the pages of the book and the front and back covers of the book cover.

It is not essential for the text book block to be bound with a false cover. In the manufacture of soft covers by perfect/burst binding processes false covers are not required. The significance of the false cover in the present method is to enable the book block to be trimmed before assembling with the present book cover. Generally, with soft back books the text book block is bound directly with the cover and then the cover and book block are trimmed together. Given the refined and rolled edge finish of the present cover, it is undesirable to trim the present cover with the book block. Hence, the book block is trimmed beforehand which requires binding a false cover. It is understood however that a book block may be bound directly with the present cover and the entire assembly trimmed or trimming of the book pages only could be carried out with an application specific machine without affecting the cover.

FIG. 1C illustrates the tracks of glue 36, 38 located between the spine crease lines 22, 24 used to adhere the pages 34 to the spine 26. In the preferred embodiment the book block is loaded into the feeding end of a perfect binder, while the covers 10, 50 are loaded into the cover feeder of the machine. The book blocks are carried over two hot glue pots. With reference to FIGS. 1C and 4C, the first glue is applied between each inner crease line 22 and the adjacent outer crease line 24 to join the edge of the front and rear end covers near the spine. This glue 38 (shown in FIG. 1C only) allows the cover when bound to hinge and is a synthetic glue having an element of elasticity that provides an amount of give to the end paper of the text book block to reduce the probability of the end covers tearing.

The second glue is a hot melt ethol vinyl acetate glue 36 which is applied between the two inner crease lines 22 to fix the spine of the text book block to the main central part of the spine 26. Once both glues have been applied the perfect binder brings the pages 34 and cover together at speed, aligns them and applies pressure on the lines of glue 36, 38 which are allowed to set to form a book 30.

Figure 6:
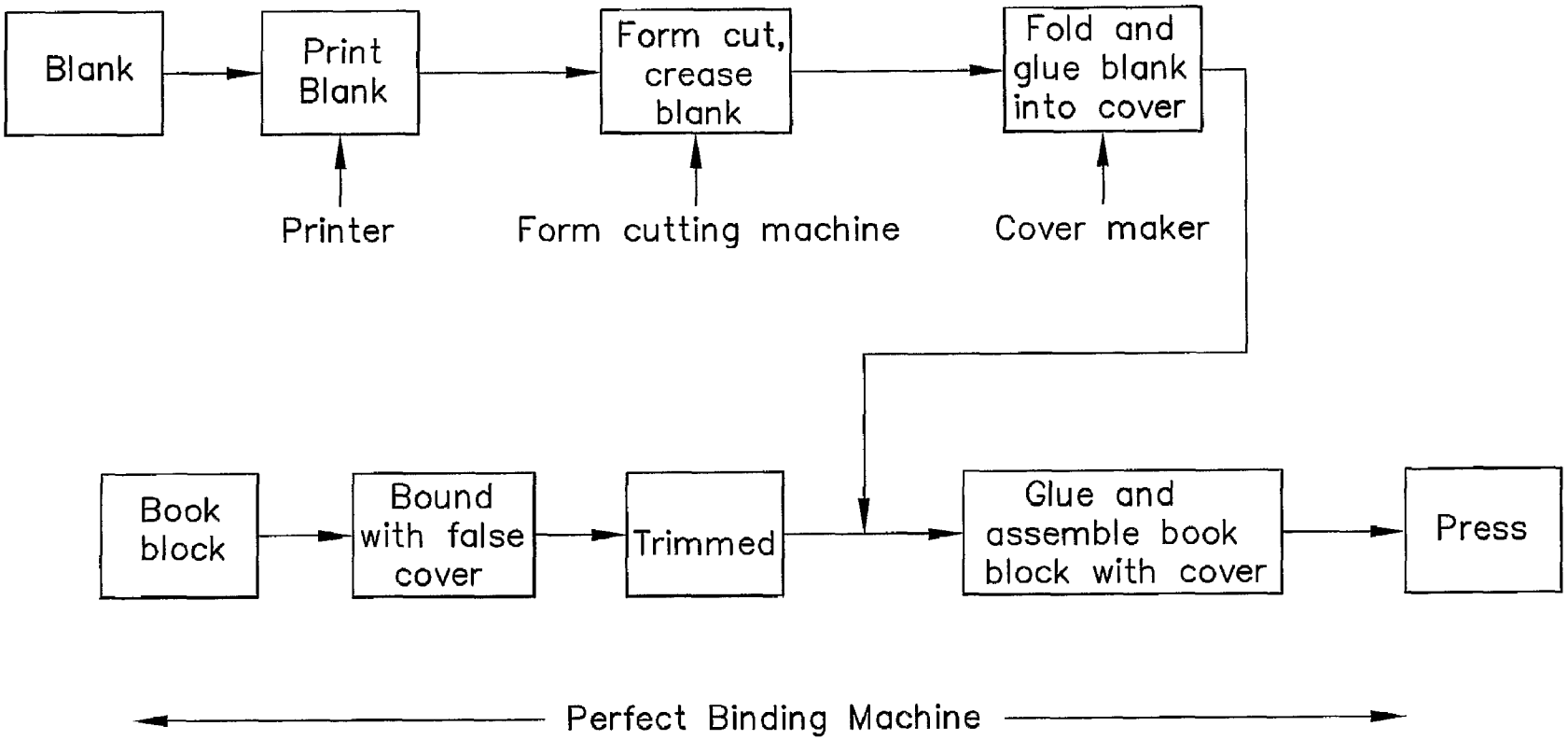
FIG. 6 is a flow chart illustrating steps involved in making a book cover and a book in accordance with the invention.

FIG. 6 is a flow chart that summarises the process described above of forming a book cover and assembling the cover with a book block. As illustrated in FIG. 6 the process of making a cover begins with a blank. The blank is a sheet of preferably 200 to 370 gsm card, and having a thickness of 100 ums to 1000 ums. The sheet is then passed through a printer where a design, pattern, colour, or the like is printed on one side of the sheet. The printed areas of the sheet are then laminated.

The sheet is then put through a form cutting machine where the blank is form cut to the desired shape from which it is folded into a cover. FIGS. 1A and 4A illustrate examples of blanks form cut to shape. At this point the blank is also creased to form fold lines and embossed as desired for aesthetic features.

For example, the sheet may be embossed to form borders on the inside or outside end covers. In another example the sheet may be embossed to form a surface having a leather-look. One advantage of the present book cover and the method of making it is that such features as a leather-look can be created in the same process as printing, which is not previously known. This allows a cover sheet material to be printed in a particular colour or even with a particular image and then embossed across the whole surface, or only part thereof, as desired to create a leather-looking book cover containing graphics and colour. Other patterns may be embossed to simulate other looks.

From the form cutting machine the form cut and creased blank is transferred to a cover maker which folds and glues the blank into a book cover ready for passing through a perfect binding machine for assembly with the book blocks. The cover maker is discussed in more detail below.

As discussed above, and still referring to FIG. 6, the book block is first bound with a false cover in order to allow trimming to be carried out prior to assembly with the book cover. Once the book block has been bound with a false cover, which may form part of outer pages of the book block text, the book block is trimmed and then reassembled at the book block feeding end of the binding machine. At this point the book covers are loaded into the cover feed of the binding machine and both the covers and book blocks are transferred through the machine. The book blocks pass by the hot glue pots after which the book blocks and covers are assembled and pressed to form the final book product.

The book cover 10 and process of manufacturing the book cover lends itself to a new range of decorative features. For example, while still in blank form the book cover maybe embossed to form a decorative border 40 as discussed above or other decorative embossed features such as text or leather-looking patterns. Embossing is a decorative feature that is usually difficult and expensive to produce on hard back covers, which are too thick to be effectively embossed. With the present book cover features such as embossing are easily carried out before folding the blank 12.

Other features are possible with the present book cover. FIG. 5 illustrates the inside of a book cover made in accordance with the second embodiment of the present invention but the features shown therein may equally apply to the first embodiment as well as other similar embodiments not discussed herein. FIG. 5 illustrates two features that can be applied on the present book cover.

The first feature appears on the left end leaf in FIG. 5 and is a window or flap 56 formed by making a cut in large flap 53 during the form cutting stage. When assembled the three sided cut on large flap 53 becomes a window 56 that can be opened to present an image 57 located underneath. The image 57 may be formed by printing images on elongate flaps 54 or by adhering an image on a separate sheet onto the folded elongate flaps 54 before folding over large flaps 53 represented by arrow C in FIG. 4C. To prevent showing the gap 55 between folded and glued elongate flaps 54, the flaps 54 may be made on one side of the blank longer than the other side so that when folded as shown in FIG. 4C the gap appears closer to the top or bottom of the folded blank and therefore clears the window that may be formed in a book cover.

This feature may be useful in, for example, children's books where the end covers themselves may form an interactive page of a book wherein a child is encouraged to lift a flap to reveal information underneath. This feature could also be used to provide a gift under the window 56, for example coupons, or sim cards where the book cover features as a mobile phone manual. In some cases such as these the window 56 may be tamper-evident in that it could be formed to be perforated so that a user is required to tear the perforations and open the window. The window may be hinged or entirely removable.

The right end leaf of the book cover illustrated in FIG. 5 illustrates a disk holder 58 held therein. This feature is useful, for example, for instruction manuals where a digital video disk may be provided to supplement the manual.

In both the above examples of special features it is important that where these features are created glue is not applied to the area occupied by the feature. For example, the window 56 must be able to open and therefore application of glue is avoided in the area of the window image 57 but will need to be applied around the image.

Similarly with the disk holder 58 to enable the disk to be inserted through the slot 59 an area inside the slot must be devoid of glue otherwise the disk will not be able to be inserted. The cover maker apparatus described below can be adjusted to apply glue only to certain areas of the blank and thereby create different features.

An extension feature of the above window is the provision of transparent windows embedded in one or more sides of the book cover. Such windows may be made of plastics or any other suitable material.

Another useful feature that takes advantage of the continuous surface of the book cover that results from folding a single blank, is the possibility of providing an image that spans the exterior and interior of the front and/or rear covers 32. FIG. 3 illustrates a book 30 with a front cover 32 printed with an image 42 spanning from the exterior 44 of front cover 32 to the interior 46 of cover 32 (FIG. 1C). Hence, a landscape picture may be provided on the front cover that continues on to the inside of the front cover of a book. The image may include writing or other decorative or informative printed material. If desired, the image may run across the exterior of both front and rear covers 32 as well as their interiors.

The above features broaden the creative scope and opportunities for designers.

The process of forming the book cover provides it with a refined and finished appearance. All edges of book cover 10 are rolled, that is folded, which is aesthetically desirable and less prone to wearing than cut edges.

Figure 7:
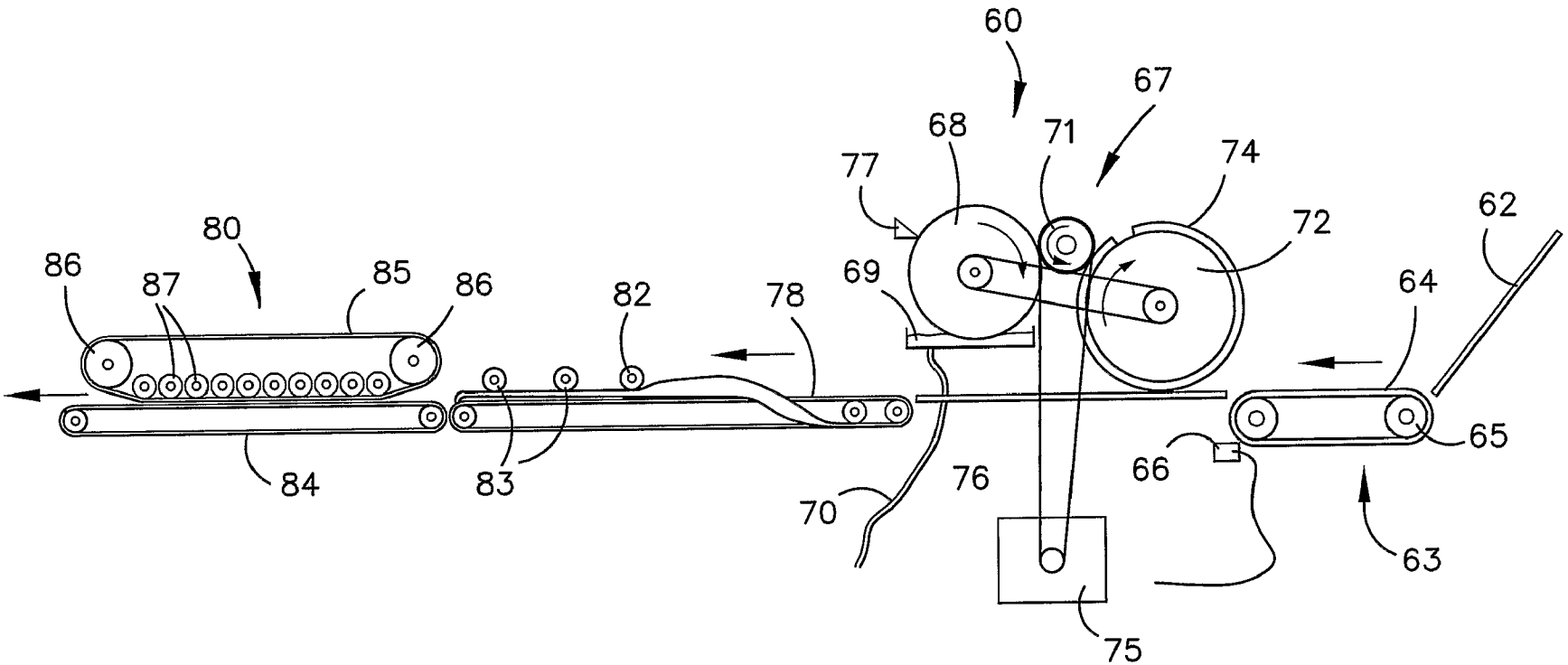
FIG. 7 is a side schematic view of an apparatus used in making the book cover.
Figure 8:
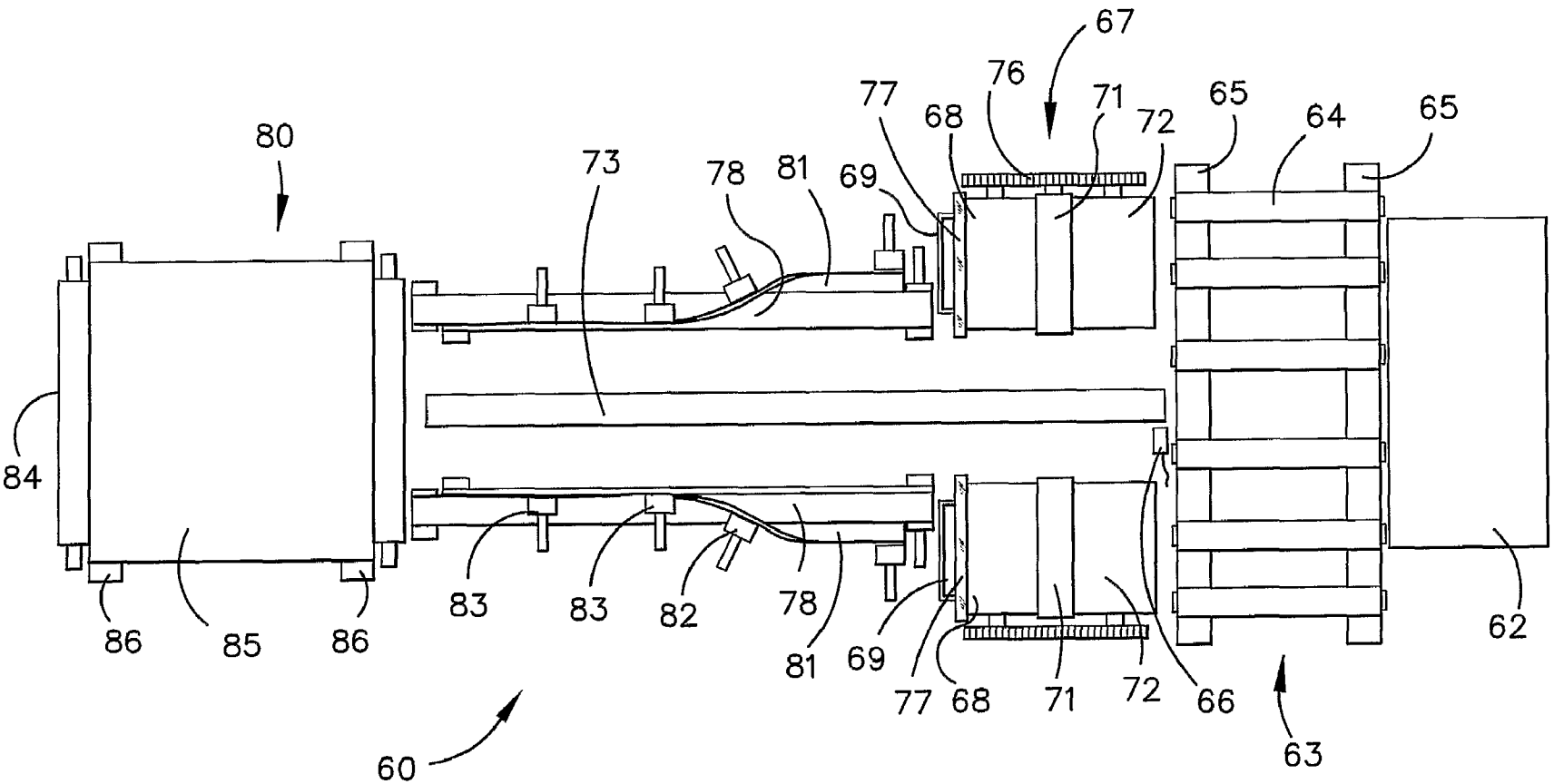
FIG. 8 is a plan view of the apparatus of FIG. 7.

FIGS. 7 and 8 schematically illustrate in side view and plan view respectively a preferred embodiment of a cover maker 60 used to glue and fold form cut and printed blanks. Prepared blanks are placed on the in-feed tray 62 of cover maker 60. In-feed tray 62 is angled so that a stack of blanks on the tray 62 feed under gravity one by one onto in-feed conveyor 63.

In-feed conveyor 63 comprises feed belts 64 driven by feed rollers 65, which are in turn driven by a motor (not shown).

The cover maker 60 is provided with two glue stations 67 located one on either side of a centre line which is directed along a longitudinal centre of the cover maker 60 defined by a central support strip 73. Accordingly, two symmetrical sides of the blank are coated with glue as the blank passes the glue station 67.

As the leading edge of the blank reaches the end of feed conveyor 63, it passes over infrared sensor 66 which triggers glue stations 67 into motion. Glue stations 67 apply adhesive to specific areas of the blank for adhering two layers together when the blank is folded. Glue stations 67 comprise take-up roller 68 that draws liquid adhesive, which may be diluted to an appropriate consistency, from a well 69. Well 69 is a shallow tray located underneath take up roller 68 and may be provided with a feed line 70 to top up the glue supply in well 69.

A smaller transfer roller 71 transfers glue from take-up roller 68 onto application roller 72. The blank is passed under glue stations 67 such that application roller 72 makes contact with a portion of the blank thereby applying glue to that portion while simultaneously moving the blank along the cover maker 60.

Application roller 72 is provided with a blanket 74 that is removably attached to the circumference of the application roller 72. Blanket 74 has a thickness and is of a rubbery nature in order to evenly apply glue onto the blank surface but can also be used to direct glue to specific areas while avoiding other areas. In other words, blanket 74 can be cut to act as a stencil where cut-out areas of the stencil define the areas on the blank which will be free of glue. This is useful where features are included in the book cover, such as the examples described above of the window flap and disk holder.

The rollers of glue stations 67 are designed to only operate when triggered by sensor 66 on the approach of a blank. By operating rollers of glue station 67 only when required prevents the build up of glue that may accumulate with continual rotation of the rollers and transfer of glue. Additionally, triggering operation of glue station 67 by sensor 66 ensures that where the blanket 74 is used as a stencil the application roller 72 is timed to apply glue to the correct area of the blank as the blank passes underneath.

An electric motor 75 triggered by sensor 66 drives take-up roller 68, transfer roller 71 and application roller 72 by way of chains and pulleys 76.

Rubber knife blades 77 are aligned across the circumference of take-up roller 68 to remove excess glue from the roller and ensure an even distribution and transfer of glue.

The blank exits glue station 67 and is drawn along cover maker 60 by a pair of transfer belts 78. Transfer belts 78 transfer the blank from glue station 67 to pressing station 80. During the transfer to pressing station 80 folders, in the form of a fold belt 81 located adjacent each transfer belt 78 and running substantially parallel to transfer belts 78, fold the wings, or opposite sides, of the blank to which glue has just been applied up and onto the central section of the blank.

Folding is carried out by, as seen in FIGS. 7 and 8, fold belt 81 being oriented flat and adjacent to each transfer belt 78 at the glue station end of the belts. As fold belts 81 progress towards pressing station 80 the belts twist, with the assistance of guide rollers 82, to a vertical position and then continue to twist back to a horizontal flat orientation whereby the belt has twisted through 180°.

As a blank is conveyed along transfer belt 78 and fold belts 81, the fold belt, as it twists, raises each side wing of the blank to fold along predefined creases, which are aligned with the twisted belts such that the sides of the blank are raised upward to a vertical position and then folded over onto the central section of the blank. Pressure rollers 83 apply pressure at the folded edges of the blank as they pass under pressure rollers 83 but on top of transfer belts 78.

Once opposite sides of a blank have been folded the entire blank is passed through pressing station 80 where pressure is applied onto the folded sides to adhere them to the central section by way of the glue located therebetween. Pressing station 80 comprises a lower transfer belt 84 and an upper sheath 85 driven by end rollers 86. Located between end rollers 86 and mounted close to the surface of transfer belt 84, is a row of pressure rolling cylinders 87 which are mounted to apply pressure onto the blank as it passes between sheath 85 and transfer belt 84.

The blank exits pressing station 80 with a pair of side wings, or flaps, folded and glued onto a central section of the blank. One pass through the cover maker 60 folds and glues one pair of flaps. The embodiments illustrated earlier in this specification describe a book cover made from folding at least two pairs of opposite flaps or two pairs of flaps where one pair are pre-folded. To glue and fold all pairs of flaps to form book cover 10, 50, requires passing the blank through the described cover maker at least twice and changing the orientation of the blank inbetween passes.

Alternatively, two cover makers 60 may be provided perpendicularly to each other such that a blank passes first through one cover maker then as it exists the first cover maker it is transferred perpendicularly to the second cover maker where it passes therethrough to glue and fold a second pair of flaps. Accordingly, with the presently described setup a blank will require to pass through a cover maker at least twice although it is envisaged that the cover maker 60 can be extended and altered to provide for gluing and folding all of the required flaps in one pass.

Once the blank has passed through the required gluing and folding process of the cover maker it is then ready to be loaded into a binding machine for binding with the book block.

The present book cover provides a strong and rigid protective cover for a book. The option of providing a two, three, four or more fold cover additionally allows for varying degrees of thickness and stiffness in the cover. For example, a four layered cover could produce a cover with an overall thickness of 2400 ums (for a blank having a thickness of 600 ums).

Because the pages are glued directly onto the centre and sides of the spine, the pages are much more securely attached to the book cover 10, 50 compared to known case binding techniques for hard back books where both end pages of a group of pages are entirely glued to the front and rear covers. In this common technique the end pages have been known to tear thereby separating the pages from the book cover. This is avoided with the present book cover and method for making the same because the spine and the side edges of the book block, i.e. grouped pages 34, are glued directly to the spine of the book cover.

The process for making the book cover is fast in relation to known case binding methods and generally more efficient. The present book cover is also much more economical to produce as it only requires one material that is printed and form cut from a blank.

Case binding of hard back books require assembly of at least four different component materials using specialised case binding equipment. The form cut blank can be worked on with normal embossing/cutting equipment and printing equipment for decorating the book cover 10 as desired. The steps of folding and gluing the blank is carried out loosely based on known packaging equipment but with some important modifications. In assembling the pages with the book cover existing book binding equipment available in the print finishing industry such as perfect or burst binding equipment is used thereby avoiding the need for manufacturing application specific equipment.

On the whole, the present book cover and method for making the book cover produces a more economical covering for a book without compromising strength and resistance to wear.

It will be understood to persons skilled in the art of the invention that many modifications may be made without departing from the spirit and scope of the invention.

The claims defining the invention are as follows:

1. A book cover comprising:

a spine between two end covers all integrally formed from a single blank of foldable board material, wherein each end cover is integrally formed into a solid and rigid panel from four layers of the blank that are folded over each other and glued, and wherein the four layers of each endcover are formed from a central section with opposing elongate flaps each hinged to the central section on opposite sides of the central section along first fold lines that are at only a part of one side of the elongate flaps, each elongate flap being folded onto itself for forming a smaller two layered flap that is folded over the central section, and a large flap foldably connected to another side of the central section along a second fold line and folded over the elongate flaps and the central section.

2. The book cover according to claim 1 wherein each end cover has solid rolled edges.

3. A book cover according to claim 1 wherein the spine is integrally formed from at least one layer of the blank.

4. A book cover according to claim 1, wherein one side of the blank is laminated with plastic so that after folding and gluing, the spine is exteriorly laminated with plastic, and each end cover is exteriorly and interiorly laminated with plastic.

5. A book cover according to claim 4 wherein the spine and each end cover is exteriorly printed with an image.

6. A book cover according to claim 5 wherein each end cover is interiorly printed with an image.

7. A book including pages bound to the spine of a book cover according to claim 1.

* * * * *